US006189495B1

(12) United States Patent
Tuckey et al.

(10) Patent No.: US 6,189,495 B1
(45) Date of Patent: Feb. 20, 2001

(54) DIRECT CYLINDER FUEL INJECTION

(75) Inventors: Charles H. Tuckey, Sand Point; J. D. Tuckey, deceased, late of Cass City; by Jay D. Tuckey, co-successor trustee, Caro; by Barbara E. Doerr, co-successor trustee, Cass City, all of MI (US)

(73) Assignee: Walbro Corporation, Cass City, MI (US)

( * ) Notice: Under 35 U.S.C. 154(b), the term of this patent shall be extended for 0 days.

(21) Appl. No.: 09/226,493

(22) Filed: Jan. 7, 1999

Related U.S. Application Data

(63) Continuation of application No. 09/178,277, filed on Oct. 23, 1998.

(51) Int. Cl.[7] ..... F02B 33/05

(52) U.S. Cl. ..... 123/73 C; 123/69 R

(58) Field of Search ..... 123/69 R, 73 C, 123/73 CC, 73 SC, 70 R, 65 R, 73 AF, 68, 65 B

(56) References Cited

U.S. PATENT DOCUMENTS

| | | | | |
|---|---|---|---|---|
| 966,362 | * | 8/1910 | Rundlof | 123/65 V |
| 967,073 | * | 8/1910 | Smith | 123/69 R |
| 1,197,951 | | 9/1916 | Pieper | 123/70 R |
| 1,266,954 | | 5/1918 | Kirk | 123/70 R |
| 1,343,980 | * | 6/1920 | Muller | 123/70 R |
| 1,344,263 | | 6/1920 | Crouse | 123/70 R |
| 1,596,398 | | 8/1926 | Burtnett | 123/70 R |
| 1,609,792 | | 12/1926 | Brock | 123/70 R |
| 1,632,468 | * | 7/1927 | Muller | 123/68 |
| 1,666,384 | * | 4/1928 | Hult | 123/70 R |
| 1,686,789 | | 10/1928 | Belden | 123/70 V |
| 1,988,082 | | 1/1935 | Latta | 123/70 V |
| 2,058,705 | | 10/1936 | Maniscalco | 123/70 V |
| 2,349,967 | * | 5/1944 | Javal | 123/68 |
| 2,776,650 | | 1/1957 | Zimmermann | 123/70 V |
| 2,939,441 | * | 6/1960 | Luttrell | 123/70 R |
| 3,774,581 | | 11/1973 | Lundy | 123/70 R |
| 4,276,858 | * | 7/1981 | Jaulmes | 123/73 CC |
| 4,715,326 | * | 12/1987 | Thring | 123/3 |
| 4,781,155 | | 11/1988 | Brucker | 123/70 V |
| 5,007,384 | | 4/1991 | Blair | 123/70 R |
| 5,033,418 | | 7/1991 | Maissant et al. | 123/70 V |
| 5,271,372 | | 12/1993 | Nuti | 123/533 |
| 5,275,134 | | 1/1994 | Springer | 123/70 R |
| 5,499,605 | * | 3/1996 | Thring | 123/70 R |
| 5,682,845 | * | 11/1997 | Woody | 123/73 A |
| 5,785,015 | * | 7/1998 | Philippe et al. | 123/70 R |
| 5,857,436 | * | 1/1999 | Chen | 123/70 R |
| 5,899,188 | * | 5/1999 | Firey | 123/250 |
| 6,019,075 | * | 2/2000 | Galka et al. | 123/70 R |

* cited by examiner

*Primary Examiner*—Henry C. Yuen
*Assistant Examiner*—Hai Huynh
(74) *Attorney, Agent, or Firm*—Reising, Ethington, Barnes, Kisselle, Learman & McCulloch, P.C.

(57) ABSTRACT

An internal combustion engine having at least one and preferably two cylinders each with a reciprocating piston, and a compressor which has a reciprocating piston driven by the engine to compress a rich fuel and air mixture within the compressor to inject the mixture directly into the combustion chamber of each engine cylinder. The mixture is ignited by a spark plug to drive the pistons of the engine through their power strokes and rotate an associated crankshaft which is connected to a compressor crankshaft to reciprocate the piston within the compressor and thereby compress and then inject the fuel and air mixture into the engine cylinder. A carburetor preferably supplies an enriched fuel and air mixture to the compressor to reduce the complexity of the system. The fuel and air mixture is preferably substantially atomized through nozzles adjacent each cylinder to improve combustion of the mixture. Preferably the engine is a two-stroke engine with two cylinders and the compressor is driven at twice the speed of the engine.

20 Claims, 5 Drawing Sheets

DIRECT CYLINDER FUEL INJECTION

REFERENCE TO RELATED APPLICATION

This application is a continuation of application Ser. No. 09/178,277 filed Oct. 23, 1998.

FIELD OF THE INVENTION

This invention relates generally to internal combustion engines and more particularly to direct cylinder fuel injection for an internal combustion engine.

BACKGROUND OF THE INVENTION

Internal combustion engines are used in a wide variety of applications to power things such as motor boats, power tools, lawn and garden equipment and a wide range of vehicles. As concern for the environment increases government regulations have been and are being promulgated requiring reduced emissions and improved fuel economy from internal combustion engines. One method used to lower the emissions and fuel consumption of internal combustion engines has been the use of fuel injectors as opposed to carburetors to meter and supply fuel to the engine. Electronic fuel injectors can be precisely timed to deliver metered quantities of fuel to the engine at the appropriate times to reduce emissions and fuel consumption and have therefore been widely used. However, electronic and computer monitored fuel injectors add considerable cost and complexity to the system and are impractical for many small engine systems which do not have a battery or generator to power and control the electronic fuel injection systems.

Another approach to lowering the fuel consumption and emission rates of internal combustion engines is to directly inject the fuel into an engine cylinder as opposed to an intake manifold of the engine which permits better timing of the injection to reduce fuel losses in the exhaust scavenge gases thereby reducing hydrocarbon exhaust emissions and decreasing the fuel consumption of the engine. In some present systems, a fuel injector delivers fuel, usually at a relatively low pressure, to a compression chamber wherein the fuel is mixed with air creating a combustionable mixture which is injected directly into the cylinder of the engine. While these systems have been effective at reducing fuel consumption and emissions from the engine they are relatively expensive due to the fuel injector and the overall complexity of the systems and also increase the size of the engine as the compression chamber is located on top of the cylinder head with one fuel injector mounted adjacent to the compression chamber of each cylinder. This is undesirable for small engines such as those in lawn and garden equipment, boat motors and small motorcycle engines and the like where a compact engine is required. Further, as discussed above fuel injectors add complexity and greatly increase the cost of the engine system.

SUMMARY OF THE INVENTION

For an internal combustion engine having at least one cylinder each with a combustion chamber defined between a cylinder head and a reciprocating piston, a valve selectively communicates a compressor, which has a reciprocating piston driven by a power transmission member, with the engine cylinder to compress a fuel and air mixture within the compressor and inject the mixture directly into the combustion chamber of each cylinder. The mixture is ignited by a spark plug to drive the piston of the engine through its power stroke and rotate the associated crankshaft which is linked through the power transmission member to a crankshaft operably associated with the piston of the compressor to rotate its crankshaft and reciprocate the piston within the compressor and thereby compress and then inject the fuel and air mixture into the engine cylinder.

The valve preferably has a passage therethrough which selectively communicates the compressor with each engine cylinder to inject a precise portion of the mixture into each engine cylinder. For an engine with a single cylinder, the compressor is preferably driven by the transmission member at a 1:1 ratio relative to the main cylinder such that the compressor causes a portion of the mixture to be injected into the main cylinder during substantially the same portion of each cycle of the piston of the main cylinder. Preferably, the injection into the main cylinder is timed so that the fuel mixture loses in the exhaust scavenge gases are minimized to reduce hydrocarbon exhaust emission and also to reduce fuel consumption of the engine.

For an engine with a pair of cylinders, the valve preferably selectively communicates the compressor individually with each of the engine cylinders to inject a precise amount of the fuel and air mixture separately into each of the engine cylinders. In a two-stroke engine application, the compressor is preferably driven by the transmission member at twice the speed of the engine cylinder such that the compressor injects substantially the same amount of the fuel and air mixture into each of the engine cylinders during substantially the same portion of each cycle of each of the engine cylinders.

To reduce the cost and complexity of the system, a carburetor preferably supplies the fuel and air mixture to the compressor and the carburetor and compressor are preferably exteriorly mounted and spaced from the engine providing a compact engine and also reducing heat transfer between the components. When so mounted, a flexible fluid conduit preferably communicates the compressor with a manifold to distribute the fuel and air mixture to the combustion chamber of each cylinder. The manifold preferably has a nozzle adjacent each of its outlets to improve dispersion and atomization of the mixture into the combustion chambers.

Objects, features and advantages of this invention include providing an engine with a fuel and air mixture mechanically injected directly into the combustion chamber of each engine cylinder which provides improved combustion within the combustion chamber, provides a precisely controlled injection event driven by the movement of the piston in the main cylinder, reduces fuel consumption of the engine, reduces exhaust emissions from the engine, allows for simple adjustment of the injection timing, provides improved injection timing to reduce the introduction of fuel into the cylinder exhaust scavenge gases, can be adapted to various existing engine designs with minimal modifications, improves run quality and starting of the engine, can be used with single or multiple cylinder engines, is compact, relatively inexpensive, of relatively simple design and economical manufacture, readily adaptable to a wide range of engine applications, and durable, requires little maintenance and has a long in-service useful life.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENTS

Figure 1:
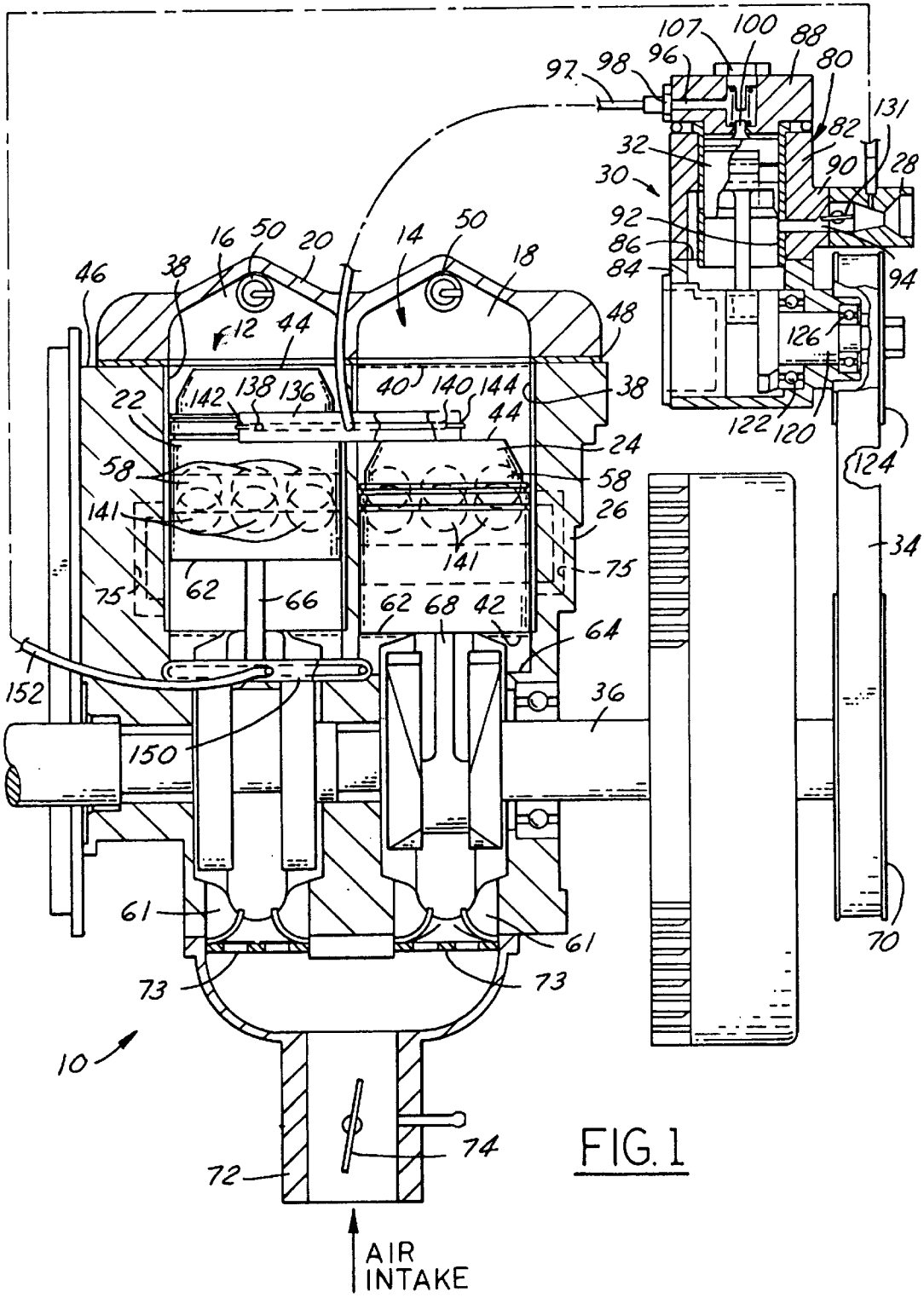
FIG. 1 is a sectional view of an internal combustion engine with two cylinders embodying this invention.
Figure 2:
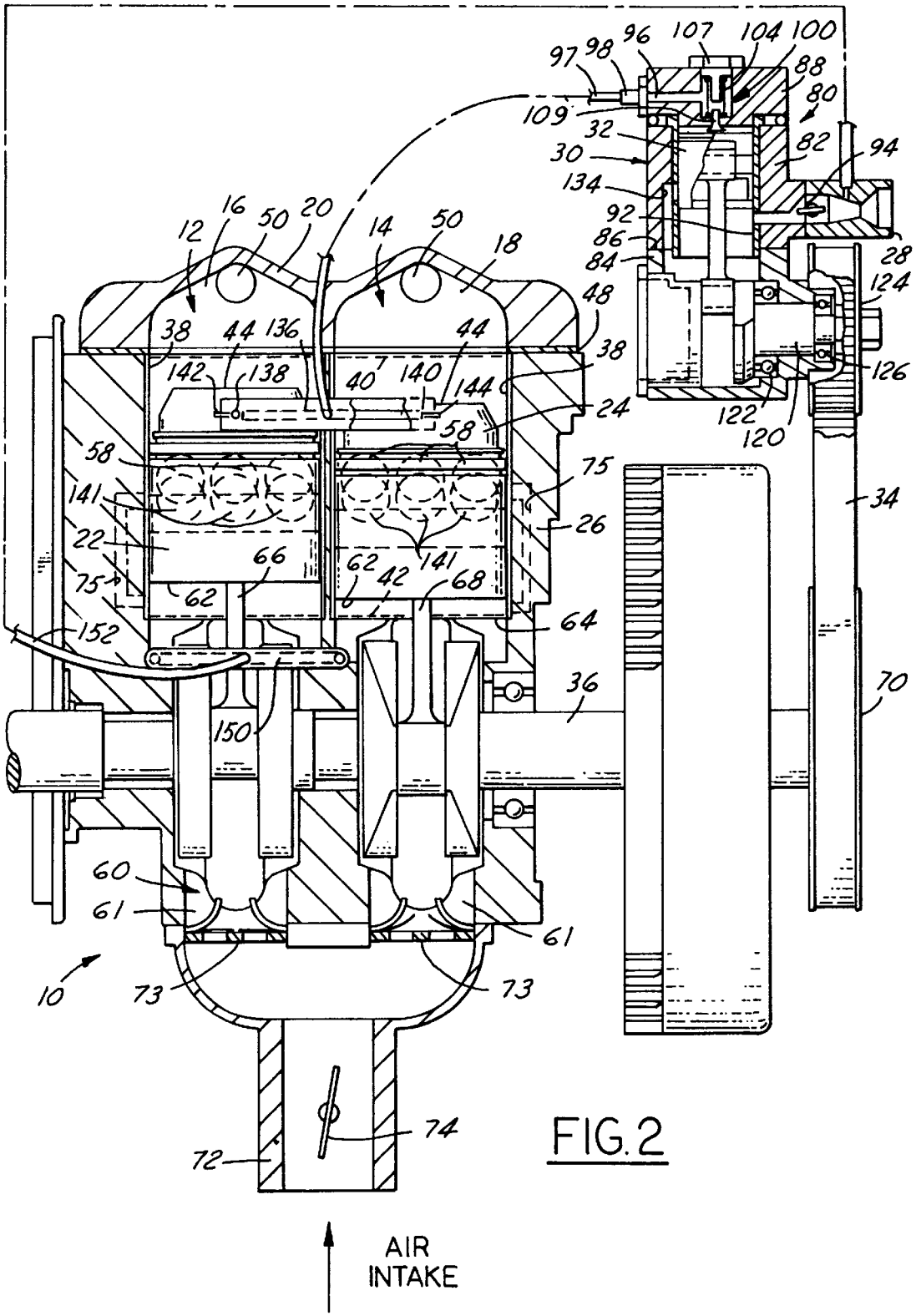
FIG. 2 is a sectional view of the engine of FIG. 1 at a second position in the engine cycle.

Referring in more detail to the drawings, FIG. 1 illustrates a two-stroke internal combustion engine 10 having a pair of cylinders 12, 14 each with a combustion chamber 16, 18 defined between a cylinder head 20 and a reciprocating piston 22, 24 within a cylinder body 26 and a carburetor 28 which delivers a rich fuel and air mixture to a compressor 30. The compressor 30 has a reciprocating piston 32 driven by a power transmission member 34 operably associated with a crankshaft 36 driven to rotate by reciprocation of the pistons 22, 24 of the main cylinders 12, 14 to compress the fuel and air mixture and inject it into the combustion chambers 16, 18 of the cylinders 12, 14. The compressor 30 is preferably mounted at a location spaced from the engine 10 to provide a more compact engine 10 which is readily adaptable to many different engine applications. Preferably, the compressor 30 is pivotally mounted and can be rotated relative to the engine 10 to vary the timing of the fuel injection.

Each cylinder 12, 14 has a central bore 32 constructed to slidably receive a piston 22,24 for linear reciprocation between first 40 and second 42 positions of its upper face 44 in the cylinder 12, 14 commonly referred to as top dead center 40 and bottom dead center 42. The cylinder head 20 is secured adjacent the upper edge 46 of the cylinder body 26 with a sealing gasket 48 received therebetween. A spark plug 50 extends through an opening in the cylinder head 20 and into each combustion chamber 16, 18. Each combustion chamber 16, 18 is defined by the upper face 44 of its piston 22, 24, the cylinder body 26 and the cylinder head 20. To allow exhaust gases to flow out of the combustion chamber 14, 16 after combustion, at least one, and preferably a plurality of exhaust ports 58 are located through the side wall of each cylinder 12,14, and are selectively communicated with the exterior of the cylinder 12 by the pistons 22, 24.

A crankcase 60 is defined between the lower face 62 of the pistons 22, 24, the cylinder body 26 and a lower wall 64 of the cylinder body 26. The crankcase 60 houses the crankshaft 36 which is powered to rotate by reciprocation of both pistons 22, 24 through connecting rods 66, 68 each pivotally connected to a piston 22, 24 at one end and connected to an eccentric throw of the crankshaft 36 at its other end. The pistons 12, 14 reciprocate such that when one piston 12 is at its top dead center position 40 the other piston 14 is at its bottom dead center position 42. A pulley 70 is operably connected to the crankshaft 36 for co-rotation therewith and is constructed to receive and drive the power transmission member 34 such as a timing or "cog" belt or chain.

To allow air flow into the crankcase 60, an air inlet 72 is provided in the crankcase 60 and has an engine air throttle valve 74 therein to selectively permit air flow therethrough. The air inlet 72 communicates with the crankcase chamber 61 for each piston through separate reed valves 73. To communicate the air in the crankcase 60 with the combustion chamber 16, 18 of each cylinder 12, 14 a transfer port 75 is located in the body 26 of each cylinder 12, 14 opening into the crankcase 60 at one end and selectively communicated with the combustion chamber 16, 18 by a piston 22, 24 at its other end. When a piston 22, 24 moves adjacent its bottom dead center position 42 the transfer port 75 of that cylinder 12, 14 is open to the combustion chamber 16, 18 and air flows from the crankcase 60 into the combustion chamber 16, 18 of that cylinder 12, 14 to provide additional air for combustion and to help purge exhaust gases from the combustion chamber 16, 18. Subsequent piston 22, 24 travel away from the bottom dead center position 42 and towards the top dead center position 40 closes the transfer port 75 to prevent air flow therethrough.

As shown in FIGS. 3–7, the compressor 30 has a secondary cylinder 80 in a body 82 mounted to a crankcase body 84 with a gasket 86 received between them, a cylinder head 88 and the piston 32 slidably received for reciprocation within the cylinder 80. The compressor 30 is preferably mounted exteriorly of the engine 10 and has an inlet 90 through the side wall 92 of the body 82 constructed to communicate with the outlet 94 of the carburetor 28 to receive the rich fuel and air mixture and an outlet 96 constructed to communicate with a fluid conduit 97 through a coupler 98 to deliver the rich fuel and air mixture to the main cylinder 12,14. The coupler 98 has an opening therethrough concentrically aligned with the fluid conduit 97 and with the outlet 96 of the compressor 30 to permit flow of the fuel and air mixture through the coupler 98.

To control the flow of the fuel and air mixture from the compressor 30 and substantially prevent reverse flow of the mixture from the fluid conduit into the compressor, a spring biased check valve 100 is disposed adjacent to the outlet 96 of the compressor 30. A valve head 102 receives one end of a coil spring 104 therein to bias the valve head 102 into engagement with a valve seat 106 to prevent flow of the fuel and air mixture through the outlet 96 of the compressor 30. Preferably, to facilitate assembly of the valve 100 within the cylinder head 88, a threaded retainer plug 107 is provided in the cylinder head 88 and has an annular groove 108 to receive and retain an end of the coil spring 104. A plunger 109 extends from the piston 32 and is constructed to contact and displace the valve head 102 from the valve seat 106 when the piston 32 is adjacent the check valve 100 the permit the fuel and air mixture to flow into the fluid conduit 97. Preferably, the pressure within the fluid conduit 97 and the force of the spring 104 tend to hold the check valve 100 closed until the plunger 109 displaces the check valve 100 so that the fuel and air mixture is at least somewhat pressurized prior to being forced into the fluid conduit 97 when the check valve 100 is open.

A compression chamber 110 is defined between the cylinder head 88, the side wall 92 and the upper face 112 of the piston 32. Adjacent the opposite side 114 of the piston 32, a crankcase chamber 116 is defined by the crankcase body 84, the side wall 92 and the piston 32.

A connecting rod 118 is pivotally connected to the piston 32 adjacent one end and rotatably connected adjacent its opposite end to an eccentric throw 119 of crankshaft 120 of the compressor 30 which is journalled for rotation by bearings 122 and 126 in the crankcase body 84 of the compressor 30. A timing pulley 124 is connected to the crankshaft 120, and receives thereon the power transmission member 34 associated with the pulley 70 of the engine crankshaft 36 for co-rotation therewith. The pulley 124 preferably has one-half the effective diameter of the pulley 70 so that the crankshaft 120 of piston 32 in the compressor 30 is driven at twice the rotary speed of the crankshaft 36 of the main cylinders 12, 14 so that the compressor 30 completes one cycle for each cycle of each cylinder 12, 14 to separately inject the fuel and air mixture into each cylinder during substantially the same portion of each cycle of each cylinder. The compressor 30 has its minimum volume when the piston 32 is at its top dead center position 128 and its maximum volume when the piston 32 is at its bottom dead center position 130. Correspondingly, the crankcase chamber 116 has its maximum volume when the piston 32 is at its top dead center position 128 and its minimum volume when the piston 32 is at its bottom dead center position 130. Currently preferred compressors 30 have a displacement or swept volume (the difference between the maximum and minimum compression chamber volume) desirably in the range of 15% to 40% of the engine displacement per cylinder and more preferably, in the range of 20% and 30%.

The carburetor 28 is constructed to deliver a rich fuel and air mixture to the inlet 90 of the compressor 30 which communicates with the crankcase chamber 116 of the compressor 30. Preferably, the fuel and air mixture supplied to the compressor 30 is in the range of about 1:2 to 1:12.5 fuel to air thus providing a rich fuel to air mixture which has a higher fuel to air content than desired for optimum combustion. Currently preferred fuel to air ratios for combustion are in the range of 1:12 to 1:18. To bring the rich injected mixture into this range additional air is supplied to the engine combustion chambers 16, 18 through the transfer port 75 when it is open. Injecting the rich fuel and air mixture is desirable because it allows a sufficient volume of fuel to be injected over a short injection duration or time which improves control over the injection event to improve fuel economy and reduce emissions from the engine. In addition, the rich fuel and air mixture is injected into each cylinder 12, 14 adjacent the spark plug 50 and enhances initial ignition of the mixture and the additional air added from the crankcase 60 provides additional oxygen to the ignited mixture to facilitate its complete combustion.

The carburetor 28 is preferably operably associated with the engine air throttle valve 74 through a throttle linkage (not shown) so that the throttle valve 131 of the carburetor 28 meters the fuel and air mixture into the compressor 30 corresponding to and proportional to engine air flow conditions. To communicate the fuel and air mixture in the crankcase chamber 116 of the compressor 30 with the compression chamber 110, a transfer passage 134 is provided in the side wall 92 of the compressor 30 and when the piston 32 travels towards its bottom dead center position 130 the upper end of the transfer passage 134 is open to the compression chamber 110. The piston 32 movement towards its bottom dead center position 130 decreases the size of the crankcase chamber 116 and compresses the fuel therein such that when the transfer passage 134 is open to the compression chamber 110, the fuel and air mixture is forced therethrough. Also, with the check valve 100 closed, the movement of the piston 32 towards its bottom dead center position 130 creates a pressure drop in the compression chamber 110 which tends to draw the mixture into the compression chamber 110 when the transfer passage 134 is open. The residence time of the fuel and air mixture in the crankcase chamber 116 is believed to enhance the dispersion and mixture of the fuel in the air.

A manifold 136 in communication with one end of the fluid conduit 97 is disposed adjacent to the cylinders 12, 14 and has a pair of outlets 138, 140 each in communication with the interior of a separate cylinder 12, 14 through at least one port in the cylinder body 26. Each outlet 138, 140 has a nozzle 142, 144 adjacent thereto to further atomize the fuel and air mixture injected into the cylinders 12, 14 and improve combustion of the mixture. The nozzles 142, 144 are selectively communicated with the combustion chamber 16, 18 of the cylinders 12, 14 by the reciprocating pistons 22, 24 therein.

During the power stroke of the cylinder 14, as its piston 24 moves towards its bottom dead center position 42, it opens the exhaust ports 58 to discharge the exhaust gases. Though the outlet 140 is open, the valve 100 is preferably closed and no fuel is discharged through the outlet 140 at this point in the engine cycle. Upon further downward movement of the piston 24, air intake ports 141 are opened and fresh air from the crankcase chamber 60 is delivered through the transfer passage 75 and intake ports 141 to scavenge exhaust gases and provide air to support combustion for the next power stroke.

After the piston 24 reaches its bottom dead center position 42, it travels back towards top dead center 40 and closes the air intake ports 141 and exhaust ports 58. Preferably, the valve 100 is opened to inject fuel into the combustion chamber 18 after the exhaust ports 58 are closed. Further movement of the piston 24 towards top dead center 42 compresses and mixes the fuel and air in the combustion chamber 18 for ignition usually somewhat before the piston 24 reaches top dead center 40 and another power stroke begins.

A second manifold 150 is disposed adjacent to the crankcase 60 and in communication with the crankcase excess oil drains for each cylinder 12, 14. The second manifold 150 communicates excess oil within the engine crankcase 60 with the outlet of the carburetor 28 through a flexible fluid conduit 152 to deliver excess engine oil to the compressor 30 to lubricate it. Excess oil flows through the fluid conduit 97 into the combustion chamber 16, 18 of the cylinders 12, 14 where it is burned with the fuel and air mixture.

Figure 8:
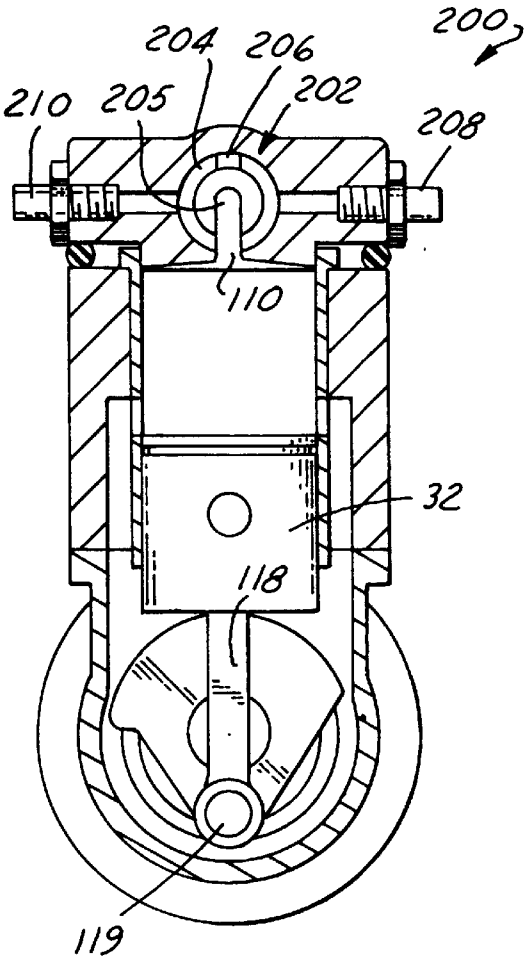
FIG. 8 is a sectional view of an alternate embodiment of the compressor.

In an alternate embodiment, as shown in FIG. 8, the compressor 200 has a rotary valve 202 with a rotating valve head 204 mounted on a stem 205 and selectively communicating a passage 206 therethrough with a pair of outlets 208, 210 of the compressor 200. The rotation of the valve head 204 is driven by the reciprocation of the piston 32 to align with the outlets 208, 210 of the compressor 200 individually and communicate the compression chamber 110 with each outlet 208, 210 to deliver a metered amount of the fuel and air mixture separately to each cylinder 12, 14 of the engine 10.

Figure 9:
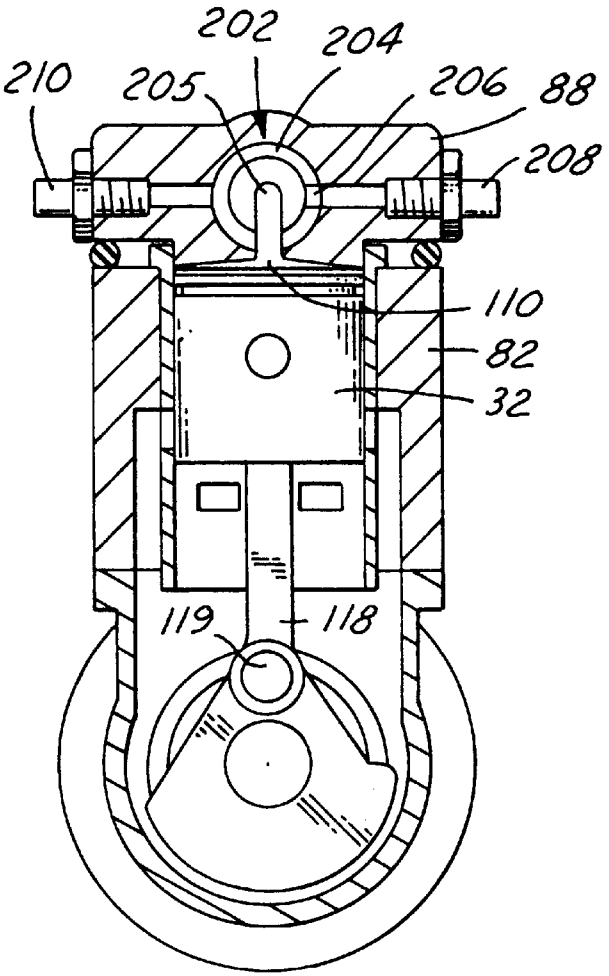
FIG. 9 is a sectional view of the compressor of FIG. 8 illustrating the piston of the compressor at top dead center.

Preferably, the valve head 204 is driven to rotate at a speed corresponding to the engine speed to deliver the fuel and air mixture separately to each cylinder 12, 14 during substantially the same portion of the cycle of each piston 22, 24. Thus, to inject each cylinder 12, 14 during substantially the same portion of each cycle, the crankshaft 120 of the compressor 200 is driven at twice the rotary speed of the crankshaft 36 of the engine 10 and the rotating valve head 204 is driven to rotate through one complete revolution for each revolution of the engine crankshaft 36 and thus at half the rotary speed of the compressor. The valve head 204 closes the outlets 208, 210 of the compressor 200 when the passage 206 through the valve head 204 is not aligned with either outlet 208 210. When both outlets 208, 210 are closed and the piston 32 moves toward its top dead center position 128, the fuel and air mixture is compressed. When the valve head 204 rotates its passage 206 into communication with one of the outlets 208, 210, as shown in FIG. 9, the fuel and air mixture is forced therethrough to be delivered under pressure to a cylinder 12, 14 of the engine 10.

Figure 10:
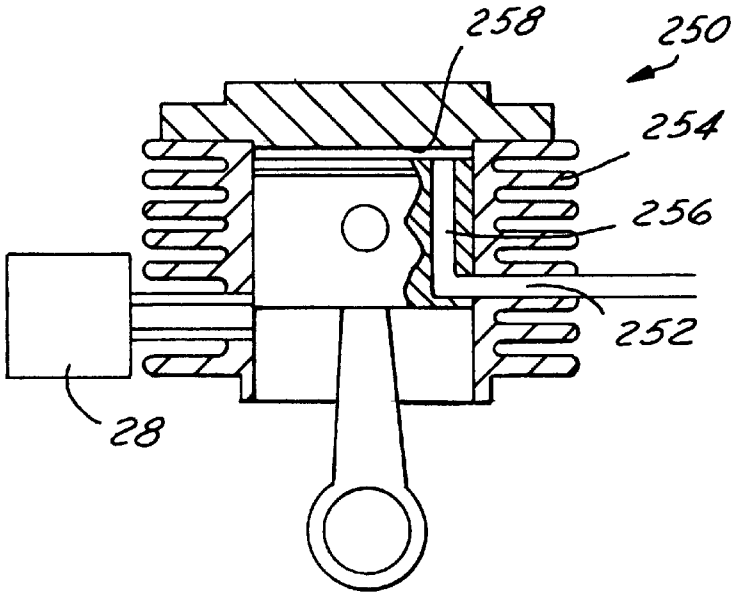
FIG. 10 is a sectional view of another embodiment of the compressor.

Another embodiment of the compressor 250 is shown in FIG. 10 and has a fuel injection port 252 through the side wall of the cylinder body 254 of the compressor 250 which is selectively communicated with a passage 256, at least partially through the piston 32 and in communication with the compression chamber 258 of the compressor 250 when the piston 32 nears its top dead center position 128. The fuel and air mixture delivered to the compressor 250 by the carburetor 28 is compressed by the upward movement of the piston 32 with the fuel injection port 252 closed by the piston 32. The fuel and air mixture is compressed until it is released under pressure through the fuel injection port 252 when aligned with the passage 256 through the piston 32 to inject the fuel and air mixture into the cylinders 12, 14 of the engine 10.

Figure 5:
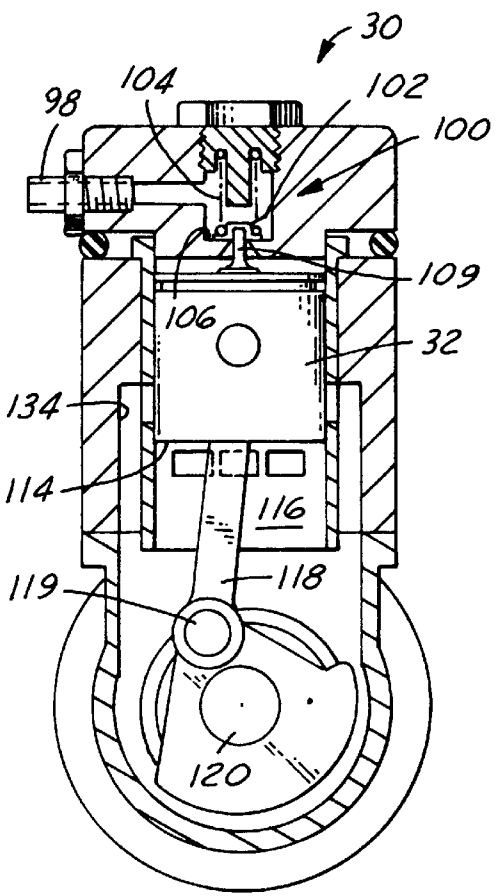
FIG. 5 is a sectional view per FIG. 4 illustrating the piston of the compressor at a position slightly before top dead center.
Figure 4:
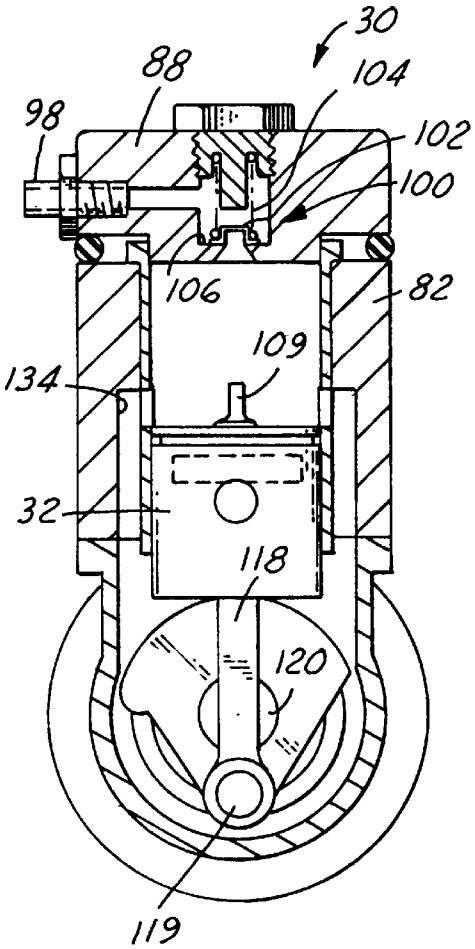
FIG. 4 is a sectional view taken along line 4—4 of FIG. 3.
Figure 3:
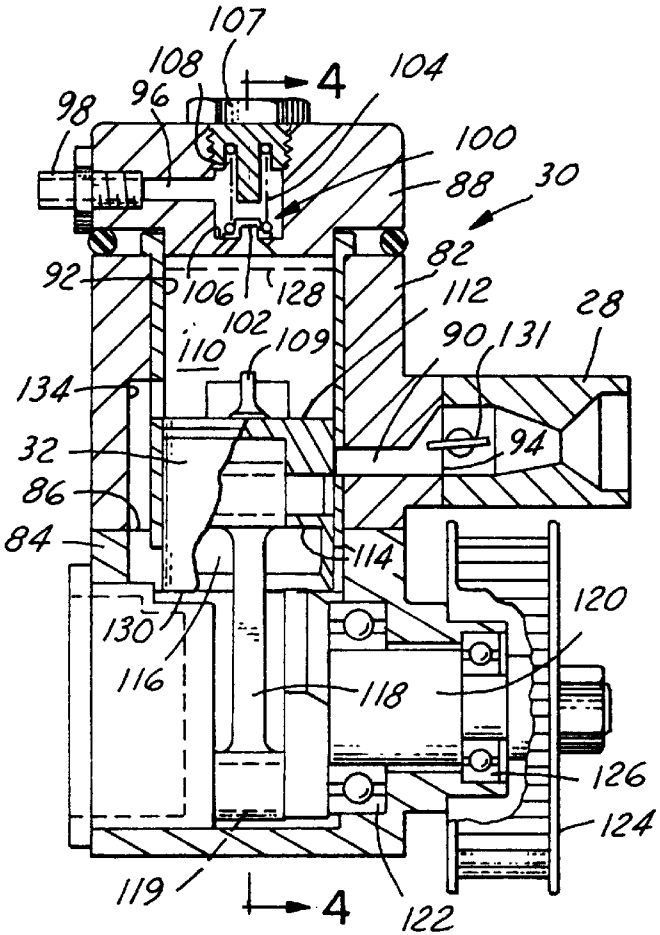
FIG. 3 is a sectional view of a compressor according to the preferred embodiment of this invention.
Figure 7:
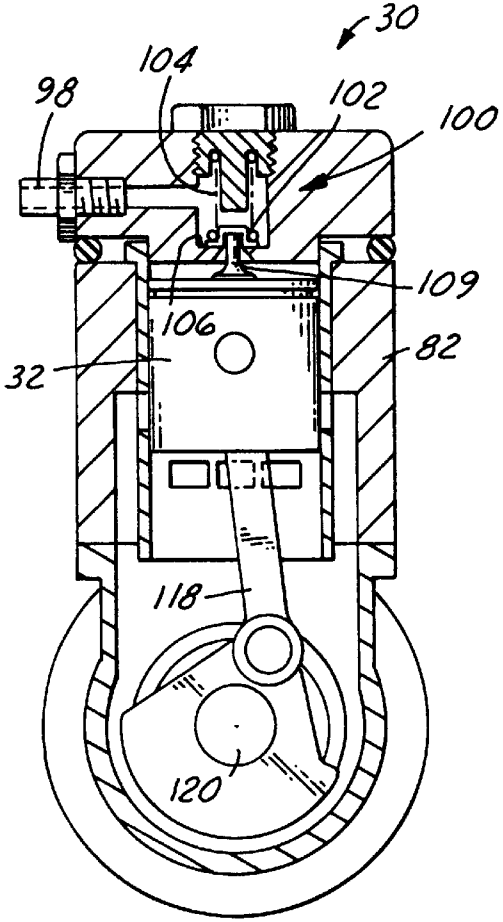
FIG. 7 is a sectional view of the compressor illustrating the piston just after top dead center.
Figure 6:
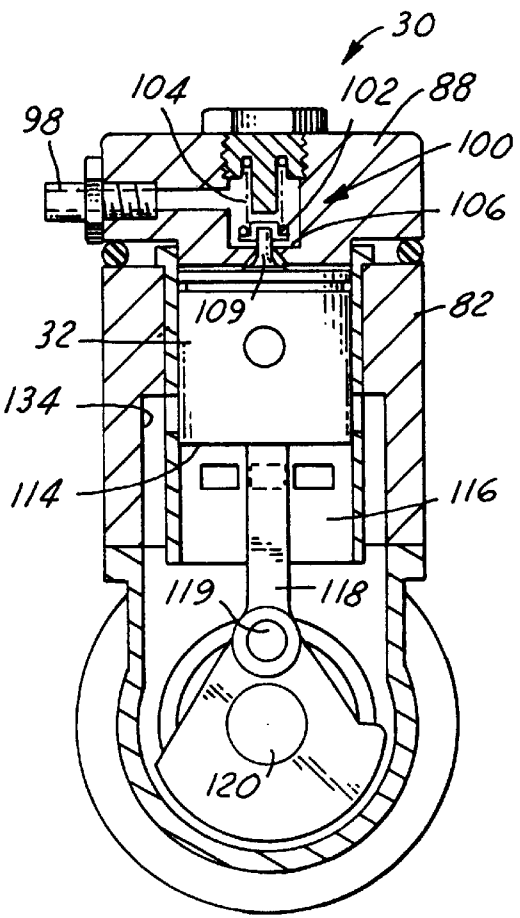
FIG. 6 is a sectional view of the compressor illustrating the piston at top dead center.

The fuel and air mixture delivered from the carburetor 28 to the crankcase chamber 116 of the compressor 30 is moved through the transfer passage 134 and into the compression chamber 110 during movement of the piston 32 towards its bottom dead center position 130 as shown in FIG. 4. Upon movement of the piston 32 towards its top dead center position 128 the piston 32 closes the transfer passage 134, as shown in FIG. 5, and compresses the fuel and air mixture within the compression chamber 110. When the plunger displaces the valve head 102 of the check valve 100 from its associated valve seat 106, as shown in FIG. 6, the fuel and air mixture is displaced through the check valve 100 and into the fluid conduit 97 until the piston 32 moves sufficiently away from its top dead center position 128 and the plunger no longer displaces the check valve 100 as shown in FIG. 7.

As the piston 22, 24 in each main cylinder 12, 14 travels toward its top dead center position 40 the volume of the combustion chamber 16, 18 decreases and the piston 22, 24 compresses the fuel and air mixture in the combustion chamber 16, 18 and increases the pressure within the combustion chamber 16, 18. Ignition of the mixture preferably occurs slightly before the pistons 22, 24 reach their top dead center position 40 and the subsequent combustion of the mixture drives the pistons 22, 24 toward their bottom dead center position 42. The downward movement of the pistons 22, 24 eventually opens the exhaust ports 58 of the cylinders 12, 14 allowing the exhaust gases of the burned mixture to escape through the exhaust ports 58.

Movement of the pistons 22, 24 rotates the crankshaft 36 which in turn, through the pulleys 70, 124 and timing belt 34, rotates the crankshaft 120 of the compressor 30. Rotation of the crankshaft 120 of the compressor 30 causes its piston 32 to reciprocate and thereby alternately transfer the fuel and air mixture from its crankcase chamber 116 to its compression chamber 110 and then to deliver the fuel and air mixture under pressure to the combustion chamber 16, 18 of each cylinder 12, 14.

Thus, the fuel and air mixture is preferably mechanically metered and directly injected into the combustion chamber 16, 18 within each cylinder 12, 14 to power the engine 10 although, if desired, a low pressure electronic fuel injector may be mounted adjacent the compressor 30 in place of the carburetor 28. For a two stroke engine with two cylinders, the compressor 30 is driven at a 2:1 ratio with the engine crankshaft 36 to inject the fuel and air mixture during substantially the same portion of each cycle of each cylinder 12, 14. The timing of the injection event can be readily changed by rotating one of the crankshafts 36, 120 relative to the other to change the portion of the cycle of the main cylinders 12, 14 in which the injection occurs or by pivoting the compressor 30 about the crankshaft axis. Further, the injection event can be timed accurately to minimize the amount of injected fuel and air mixture which is lost with the exhaust scavenged gases. This greatly reduces the hydrocarbon emissions of the engine 10 and also greatly reduces the fuel consumption of the engine 10. Still further, the system is of relatively low cost and is easily adaptable to current engine designs and many current engine applications.

What is claimed is:

1. An engine comprising:

at least two cylinders;

a piston slidably received for linear reciprocation within each cylinder and defining a combustion chamber with the cylinder;

a spark plug communicating with each combustion chamber;

a crankshaft operably associated with the pistons and powered to rotate in one direction by the pistons;

a positive displacement pump having an inlet to receive a fuel and air mixture and an outlet to deliver the compressed fuel and air mixture under superatmospheric pressure directly to the combustion chambers of the cylinders;

a power transmission member operably connecting the crankshaft and the pump to drive the pump in timed relationship with movement of the pistons in the cylinders; and a valve selectively communicating the pump outlet with each of the cylinders in timed relationship with movement of the piston in each cylinder whereby the pump delivers the fuel and air mixture separately to each of the cylinders through the valve in timed relationship with the cycle of each piston in its associated cylinder.

2. The engine of claim 1 wherein the pump has a secondary cylinder with a piston slidably received for reciprocation in the secondary cylinder, and a crankshaft operably connected with the piston of the secondary cylinder and journalled for rotation to reciprocate the piston in the secondary cylinder.

3. The engine of claim 2 wherein the power transmission member operably connects the pump crankshaft with the engine crankshaft, and the engine is a two stroke engine and has a pair of cylinders and the pump crankshaft is driven at a speed twice that of the engine crankshaft.

4. The engine of claim 2 wherein the piston of the pump has a passage at least partially therethrough selectively communicated with the pump outlet as the piston reciprocates to compress and force the fuel and air mixture through the pump outlet.

5. The engine of claim 1 wherein the engine has a pair of cylinders and the valve has a pair of outlets each in communication with a separate cylinder and the valve selectively communicates the pump outlet with each cylinder.

6. The engine of claim 1 wherein the engine is a two stroke engine and has a pair of cylinders and the pump is driven at twice the speed of the engine crankshaft and the valve communicates the pump with each cylinder to supply fuel to each cylinder separately and during substantially the same portion of each cycle of each cylinder.

7. The engine of claim 1 wherein the valve has at least one outlet for each cylinder and each outlet is selectively communicated with its respective cylinder by the piston within that cylinder.

8. The engine of claim 7 wherein the engine has a pair of cylinders and the valve is a manifold with an outlet in communication with the interior of each cylinder and reciprocation of the piston in each cylinder communicates the associated outlet with its associated cylinder.

9. The engine of claim 1 wherein the pump has a check valve adjacent its outlet to substantially prevent reverse flow of the fuel and air mixture therethrough.

10. The engine of claim 9 wherein the piston of the pump has a projection engageable with the check valve to open the check valve and permit flow of the fuel and air mixture therethrough.

11. The engine of claim 1 wherein the valve has a rotating valve head with a passage therethrough in communication with the pump outlet and with the cylinder during at least a portion of its rotation.

12. The engine of claim 11 wherein the valve head rotates at the same speed as the engine crankshaft to deliver the fuel and air mixture to the cylinder during substantially the same portion of each piston cycle in each engine cylinder.

13. The engine of claim 12 which comprises a pair of cylinders and the valve selectively communicates the pump with each cylinder during each rotation of the valve head.

14. The engine of claim 1 wherein the pump has a crankcase, a secondary cylinder communicating adjacent one end with the crankcase, a piston slidably received for reciprocation in the secondary cylinder, a crankshaft received in the crankcase and operably connected with the piston of the secondary cylinder and journalled for rotation to reciprocate the piston in the secondary cylinder, a transfer port between the secondary cylinder and the crankcase of the pump which is opened and closed to communication with the secondary cylinder by reciprocation of the piston therein, and also comprises a carburetor for supplying a rich fuel and air mixture to the crankcase of the pump in response to movement of the piston in the secondary cylinder and a rich fuel and air mixture in the crankcase is delivered through the transfer passage to the secondary cylinder in response to movement of the piston opening the transfer passage to communicate with the secondary cylinder.

15. An engine, comprising:

a two-stroke engine having at least two cylinders;

a separate piston slidably received for linear reciprocation within each cylinder and defining a combustion chamber with the cylinder, the combustion chambers being independent;

a separate spark plug communicating with each combustion chamber;

a crankshaft operably associated with the pistons and powered to rotate in one direction by the pistons;

a positive displacement pump having a crankcase, an inlet to the crankcase to receive a fuel and air mixture, an outlet to deliver the fuel and air mixture under pressure to each cylinder, a secondary cylinder communicating adjacent one end with the crankcase, a piston slidably received for reciprocation in the secondary cylinder, a crankshaft in the crankcase and operably connected with the piston of the secondary cylinder and journalled for rotation to reciprocate the piston in the secondary cylinder, and a transfer passage from the crankcase of the pump to the secondary cylinder and opened and closed to communication with the secondary cylinder by reciprocation of the piston in the secondary cylinder;

a carburetor communicating with the crankcase of the pump to supply a rich fuel and air mixture to the crankcase in response to movement of the piston in the secondary chamber, and transfer of the rich fuel and air mixture from the crankcase to the secondary cylinder in response to the piston opening the transfer passage to communicate with the secondary cylinder;

a power transmission member operably connecting the engine crankshaft with the pump crankshaft to drive the pump; and a valve selectively communicating the pump outlet with each of the cylinders whereby the pump delivers the fuel and air mixture separately to each cylinder through the valve.

16. The engine of claim 15 wherein the engine is a two-stroke engine and has a pair of cylinders and the pump crankshaft is driven at a speed twice that of the engine crankshaft.

17. The engine of claim 15 wherein the engine is a two-stroke engine and has a pair of cylinders and the pump is driven at twice the speed of the engine crankshaft and the valve communicates the pump with each cylinder to supply fuel to each cylinder separately and during substantially the same portion of each cycle of each cylinder.

18. The engine of claim 15 wherein the pump has a check valve adjacent its outlet to substantially prevent reverse flow of the fuel and air mixture therethrough.

19. The engine of claim 15 wherein the valve has a rotating valve head with a passage therethrough in communication with the pump outlet and with the cylinders during at least a portion of its rotation.

20. The engine of claim 19 wherein each valve head rotates at the same speed as the engine crankshaft to deliver the fuel and air mixture to the cylinders during substantially the same portion of each piston cycle in the engine cylinder.

* * * * *

UNITED STATES PATENT AND TRADEMARK OFFICE

CERTIFICATE OF CORRECTION

PATENT NO. : 6,189,495 B1
DATED : February 20, 2001
INVENTOR(S) : Charles H. Tuckey and J.D. Tuckey It is certified that error appears in the above-identified patent and that said Letters Patent is hereby corrected as shown below:

Column 10,
Line 53, delete "the cylinders" and insert -- each cylinder --.
Line 54, delete "cylinder" and insert -- cylinders --.

Signed and Sealed this

Eighteenth Day of December, 2001

*Attest:*

*Attesting Officer*

JAMES E. ROGAN
*Director of the United States Patent and Trademark Office*